US007267422B2

(12) United States Patent
Brookmire et al.

(10) Patent No.: US 7,267,422 B2
(45) Date of Patent: Sep. 11, 2007

(54) PURGING FIXING-LIQUID EJECTION DEVICES

(75) Inventors: Michael Brookmire, Washougal, WA (US); Russell P. Yearout, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 383 days.

(21) Appl. No.: 10/862,519

(22) Filed: Jun. 7, 2004

(65) Prior Publication Data

US 2005/0270327 A1 Dec. 8, 2005

(51) Int. Cl.
*B41J 2/165* (2006.01)

(52) U.S. Cl. ..... 347/22; 347/35

(58) Field of Classification Search ..... 347/14, 347/15, 21–23, 35, 43, 19, 40, 20, 29–36; 400/701

See application file for complete search history.

(56) References Cited

U.S. PATENT DOCUMENTS

| | | | | |
|---|---|---|---|---|
| 4,833,491 | A * | 5/1989 | Rezanka | 347/43 |
| 5,659,342 | A * | 8/1997 | Lund et al. | 347/35 |
| 6,296,342 | B1 * | 10/2001 | Oikawa | 347/21 |
| 6,619,784 | B2 | 9/2003 | Bauer | 347/35 |
| 6,932,455 | B2 * | 8/2005 | Monclus et al. | 347/22 |

* cited by examiner

*Primary Examiner*—Juanita D. Stephens

(57) ABSTRACT

Methods and apparatus are provided. Nozzles of a fluid-ejection device of an imaging device adapted to eject a clear fixing liquid are purged by ejecting a number of drops of the clear fixing liquid through the nozzles onto a non-imaging portion of a media sheet.

25 Claims, 4 Drawing Sheets

PURGING FIXING-LIQUID EJECTION DEVICES

BACKGROUND

Many imaging devices, such as printers, facsimile devices, multifunction peripherals (MFPs), etc., dispose images onto a print media, such as paper, using a fluid-ejection device, such as an inkjet print head, that ejects droplets of a marking fluid, such as ink, onto the print media through a set of nozzles. One problem is that the nozzles, especially seldom used nozzles, frequently become clogged or otherwise contaminated with a variety of contaminants, such as dried ink and paper fibers. This adversely impacts the placement and volume of output droplets, as the droplet may be deflected from its intended destination and less than all ink may escape the nozzle. Conventional imaging devices often include a spittoon in which ink drops are periodically disposed (or "spit") to purge the nozzles.

Some imaging devices employ a separate fluid-ejection device that ejects droplets of a clear fixing liquid (or "fixer") onto the print media prior to depositing the ink (often referred to as "under-printing"), e.g., to improve color saturation, water-fastness, edge acuity, and durability of inkjet printed images, etc. This is achieved when the fixing liquid reacts with the inkjet ink either on or in the print media. A clear fixing liquid can also be overprinted onto inkjet printed images, e.g., to reduce drying time and smearing, increase image permanence, etc.

Typically, the fluid-ejection device is expected to deposit the clear fixing liquid in a precise pattern corresponding to the printed images. One problem is that fixing liquids can crust nozzles on the fluid-ejection device, internally and externally, and thus degrade nozzle performance, more quickly than ink. Such nozzle degradation can produce an inferior image with inferior image uniformity and permanence. Consequently, fixing liquids have to be purged (or spit) more frequently and in larger quantities than inks, causing spittoons to fill more quickly, leading to increased spittoon maintenance. Moreover, fixing liquids often react with the ink contained in a spittoon, e.g., causing the inks to solidify within the spittoon, leading to spittoon malfunction.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
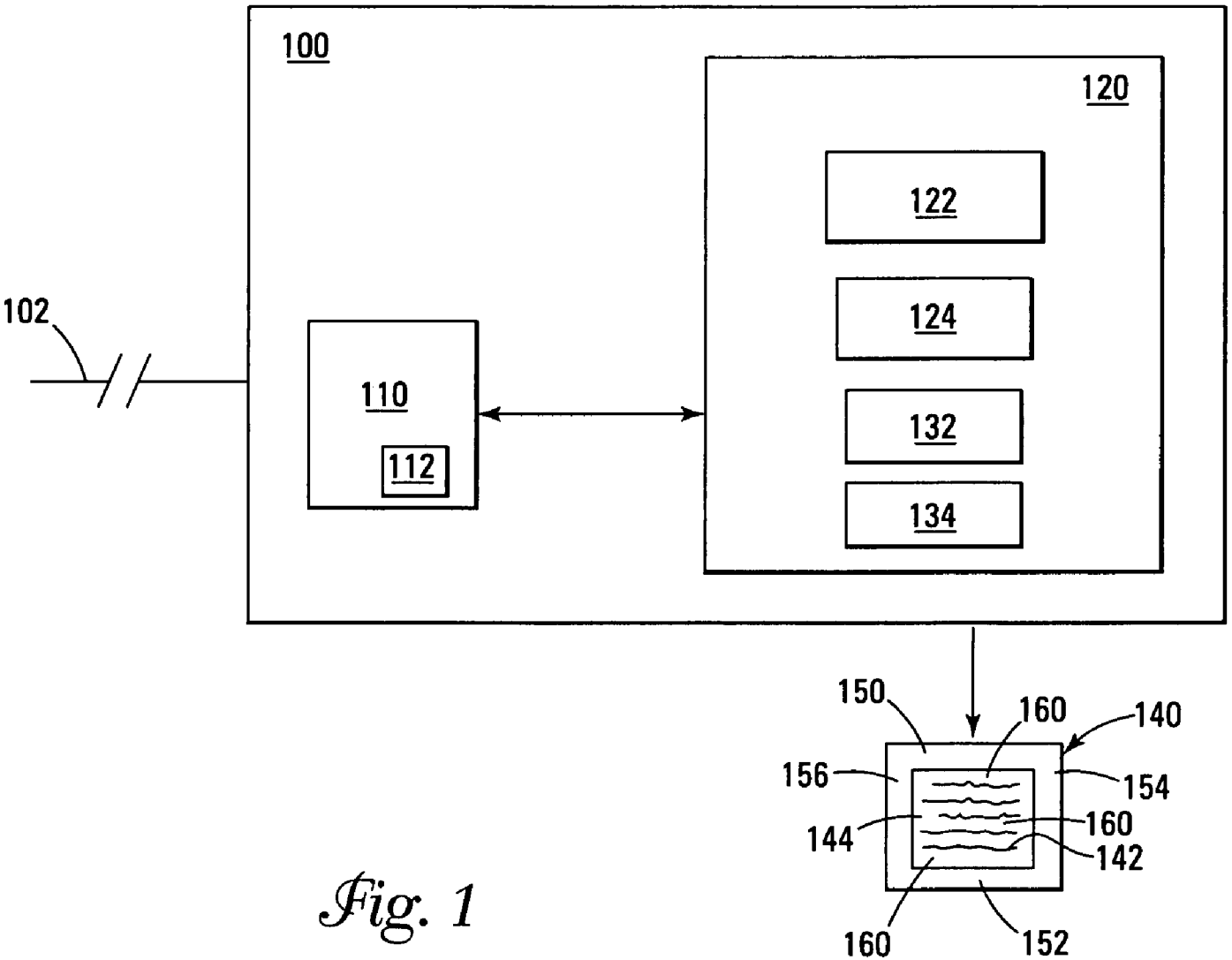
FIG. 1 is a block diagram of an imaging device, according to an embodiment of the present invention.

FIG. 1 is a block diagram of an imaging device 100, according to an embodiment of the present invention. Imaging device 100 can be an inkjet printer, a digital network copier, a multi-function peripheral (MFP), a facsimile machine, etc. Imaging device 100 may be connected directly to a personal computer, workstation, or other processor-based device system, or to a data network, such as a local area network (LAN), the Internet, a telephone network, etc., via an interface 102.

For one embodiment imaging device 100, receives image data via interface 102. Imaging device 100 has a controller 110, such as a formatter, for interpreting the image data and rendering the image data into a printable image. The printable image is provided to a print engine 120 to produce a hardcopy image 142. The hardcopy image 142 is produced on a media sheet 140, such as paper, transparent plastic, etc. Portions of media sheet 140 destined receive the hardcopy image 142 thereon are imaging portions of the media sheet 140. For another embodiment, the imaging device 100 is capable of generating its own image data, e.g., a copier via scanning an original hardcopy image.

Controller 110 includes a memory 112, e.g., a computer-usable storage media that can be fixedly or removably attached to imaging device 100. Some examples of computer-usable media include static or dynamic random access memory (SRAM or DRAM), read-only memory (ROM), electrically-erasable programmable ROM (EEPROM or flash memory), magnetic media and optical media, whether permanent or removable. Memory 112 may include more than one type of computer-usable storage media for storage of differing information types. For one embodiment, memory 112 contains computer-readable instructions, e.g., drivers, adapted to cause controller 120 to format the data received by imaging device 100, via interface 102 or by scanning, and computer-readable instructions to cause imaging device 100 to perform various methods, as described below.

Print engine 120 represents the mechanical aspects of the imaging device 100. For one embodiment, print engine 120 includes a source 122 for supplying the print engine 120 with one or more media sheets 140. Examples of the source 122 include media trays or by-pass feeders. Print engine 120 includes an ink delivery system 124 that receives a media sheet 140 from source 122 for printing the hardcopy image 142 thereon. For one embodiment, ink delivery system 124 includes fluid-ejection devices, such as print heads, that are respectively fluidly coupled to marking-fluid reservoirs, such as ink reservoirs. The ink reservoirs may be integral with their respective print heads or may be separated from their respective print heads and fluidly coupled thereto by conduits. The print heads have nozzles for ejecting ink droplets onto print media 140 for creating the hardcopy image 142 thereon.

For other embodiments, print engine 120 has a capping device 132 and a spittoon 134. When the print heads are not in use, they are capped by capping device 132 to prevent the print heads from drying out. Moreover, the print heads can be moved to spittoon 134, e.g., between printing on successive media sheets 140, so that the print heads can eject (or spit) a predetermined number of drops through their nozzles into spittoon 134 to purge the nozzles of unwanted debris, such as dried ink, paper fibers, etc. For some embodiments, the capping device 132 and spittoon 134 are located in the same general area of imaging device 100 and constitute a service station of imaging device 100.

The computer-readable instructions of memory 112 instruct print engine 120 to print hardcopy image 142 within a predefined print region 144 of media sheet 140. The predefined print region 144 is defined by specifying margins adjacent a periphery of media sheet 140. Specifically, a top margin 150 is defined adjacent a leading edge of media sheet 140 as media sheet 140 travels through imaging device 100, a bottom margin 152 defined adjacent a trailing edge of media sheet 140, and opposing side margins 154 and 156 are defined adjacent opposing sides of media sheet 140. For one embodiment, a user specifies the margins, e.g., using a personal computer or other processing device.

Figure 2:
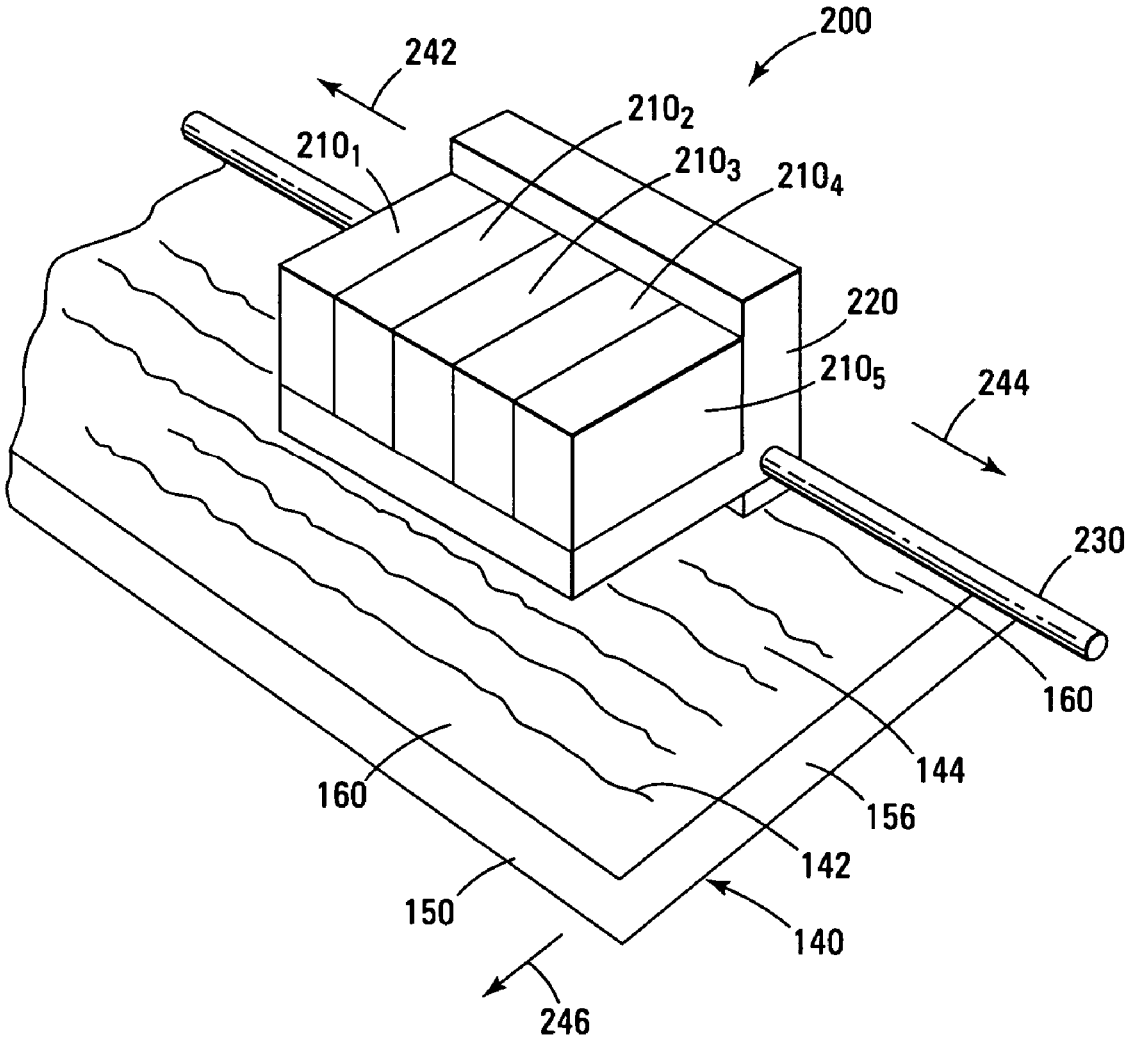
FIG. 2 is an isometric view of a portion of a print engine, according to another embodiment of the invention.

FIG. 2 is an isometric view of a portion of a print engine 200, e.g., a portion of the print engine 120 of imaging device 100 of FIG. 1, according to another embodiment of the invention. Print engine 200 includes print heads 210 disposed in a carriage 220 that is movably attached to a rail 230. Carriage 220 carries print heads 210 across print media 140 in the directions of arrows 242 and 244 as print media 140 moves in the direction of arrow 246 that is substantially perpendicular to the direction of motion of carriage 220. As carriage 220 carries print heads 210 across print media 140, print heads 210 eject ink droplets through their nozzles onto media sheet 140 within print region 144, producing hardcopy image 142. Imaging devices that incorporate print engines, such as print engine 200, having print heads that move across the media sheets during printing are often called scanning printers.

For one embodiment, print heads $\mathbf{210}_1$ to $\mathbf{210}_4$ respectively eject substantially opaque black, cyan, magenta, and yellow inks onto print region 144 to produce the hardcopy image 142 thereon. For one embodiment, print head $\mathbf{210}_5$ ejects a clear fixing liquid (or "fixer") through its nozzles onto print region 144 in an "under-printing" process prior to print heads $\mathbf{210}_1$ to $\mathbf{210}_4$ ejecting their inks onto print region 144. Print heads $\mathbf{210}_1$ to $\mathbf{210}_4$ subsequently eject their inks on the fixing liquid. For another embodiment, the fixing liquid includes a cationic polymer, cationic multivalent metal salts and/or a cationic surfactant that precipitates anionic dyes or anionic pigments in the inks ejected from print heads $\mathbf{210}_1$ to $\mathbf{210}_4$ either on or in print media 140, e.g., to improve color saturation, water-fastness, edge acuity, and durability of the hardcopy image 142. For another embodiment, print head $\mathbf{210}_5$ ejects the clear fixing liquid onto the hardcopy image 142 in an overprinting process, e.g., to reduce drying time and smearing, increase image permanence, etc.

For some embodiments, carriage 220 carries print heads 210 to a spittoon, such as spittoon 134 of imaging device 100 of FIG. 1, between printing on successive media sheets 140, and each of print heads $\mathbf{210}_1$ to $\mathbf{210}_4$ spit a predetermined number of ink drops through its nozzles into spittoon 134 to purge the nozzles of any unwanted debris. Typically, for a given length of time that a print head is in an uncapped state (de-cap time), i.e., not capped by a capping device, print heads need to spit more drops of fixing liquid than ink to prevent nozzle clogging because fixing liquids usually dry more quickly than inks. The extra volume of spat fixing liquid causes spittoons to fill more quickly, thus requiring more spittoon maintenance. Moreover, fixing liquids often react with the ink contained in a spittoon, e.g., causing the inks to solidify within the spittoon, leading to spittoon malfunction.

To avoid the problems associated with spitting fixing liquid into a spittoon, print head $\mathbf{210}_5$ spits a predetermined number of drops of the fixing liquid through its nozzles onto a non-imaging portion of media sheet 140 to purge the nozzles of any unwanted debris, such as dried fixer, etc. The non-imaging portion of media sheet 140 may include margins 150, 152, 154, and/or 156 and/or portions 160 of print region 144 that are not destined to receive the hardcopy image 142, as best shown in FIG. 1, such as "white-space" located on print region 144 that is adjacent hardcopy image 142. For one embodiment, the nozzles of print head $\mathbf{210}_5$ are purged by spitting the fixing liquid onto margin 150 prior to ejecting the fixing liquid in print region 144. For some embodiments, when printing on a succession of media sheets 140, the fixing liquid is spit onto margin 150 of each of the media sheets 140 prior to ejecting fixing liquid within the print region 144 of each of the respective media sheets 140. For another embodiment, print head $\mathbf{210}_5$ spits a predetermined number of drops of the fixing liquid onto margin 152 (shown in FIG. 1) of media sheet 140 after ejecting the fixing liquid in print region 144. For another embodiment, print head $\mathbf{210}_5$ may spit a predetermined number of drops of the fixing liquid onto margins 150 and 152 (shown in FIG. 1) of media sheet 140 before and after ejecting the fixing liquid in print region 144, respectively. For another embodiment, print head $\mathbf{210}_5$ may spit a predetermined number of drops of the fixing liquid onto margins 150 and 152 (shown in FIG. 1) of media sheet 140 before and/or after ejecting the fixing liquid in print region 144, respectively, onto margins 154 and/or 156, and/or onto portions 160. For some embodiments, not all of the fixing liquid is spit onto the non-imaging portion of media sheet 140 for purging the nozzles of print head $\mathbf{210}_5$. Instead, print head $\mathbf{210}_5$ spits some of the fixing liquid into spittoon 134 to purge its nozzles.

For one embodiment, the number of drops to be spit onto the non-imaging portion of media sheet 140 and, for some embodiments, into spittoon 134 is based on the de-cap time. This can be accomplished by using a look-up table that is stored in a memory of the imaging device, such as memory 112 of imaging device 100 of FIG. 1, that includes the number of drops of fixing liquid that need to be spit to purge the nozzles of a print head versus de-cap time. For another embodiment, the number of drops of fixing liquid that need to be spit to purge the nozzles of a print head versus de-cap time are included at different temperatures and/or values of relative humidity. Such information can be obtained empirically. In this embodiment, the imaging device measures the de-cap time, relative humidity, and/or temperature, and the number of drops of fixing liquid that need to be spit on the non-imaging portion of media sheet 140 and, for some embodiments, into spittoon 134 is looked up in the look-up table for these values. For one embodiment, the number of drops to be spit on the non-imaging portion of media sheet 140 and, for some embodiments, into spittoon 134 corresponds to a default value. The default value may be based on a worst-case scenario, e.g., low relative humidity, large de-cap time, and/or high temperature, in which case a maximum number of drops will be spit.

Figure 3:
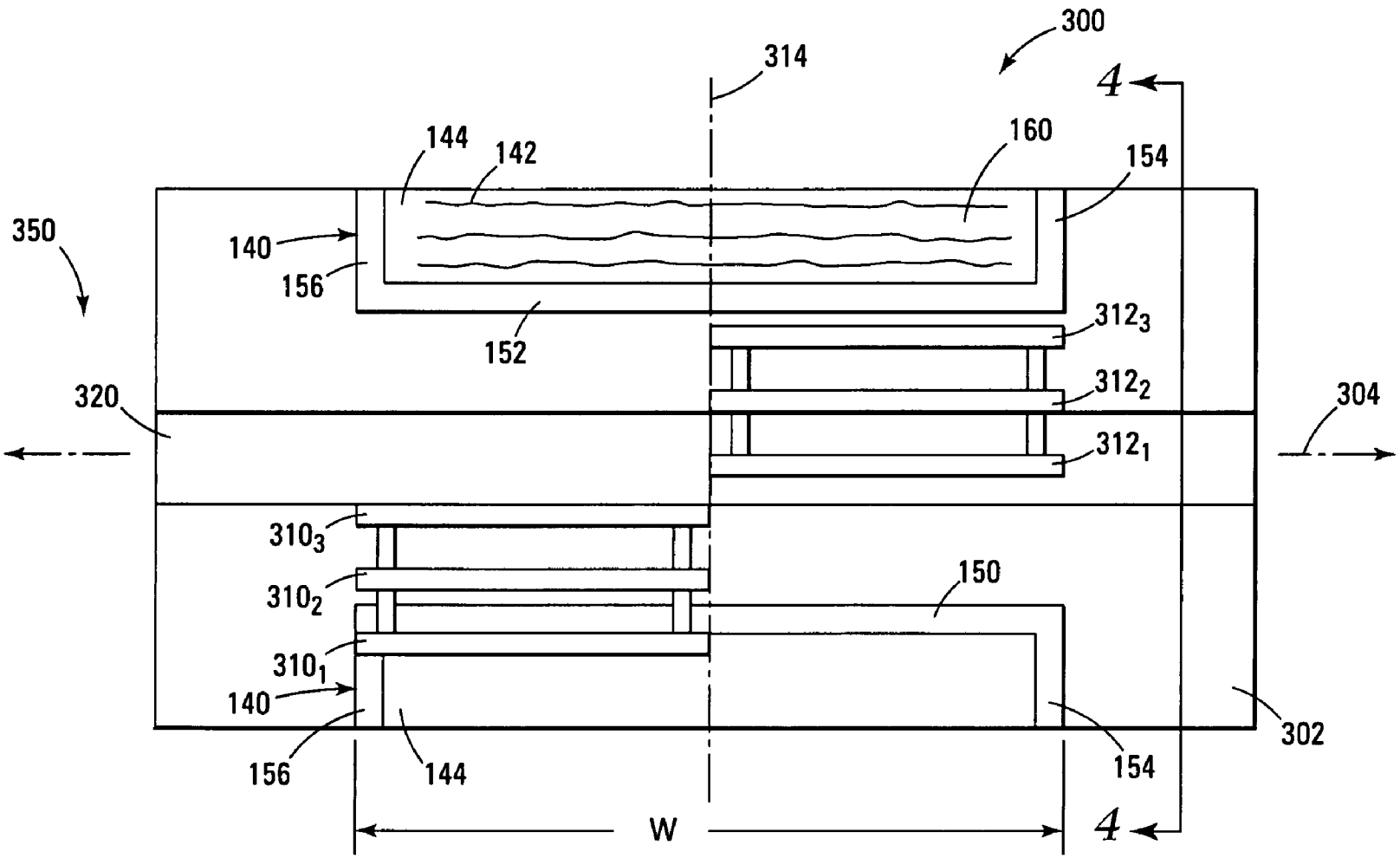
FIG. 3 is a top view of a portion of a print engine, according to another embodiment of the invention.
Figure 4:
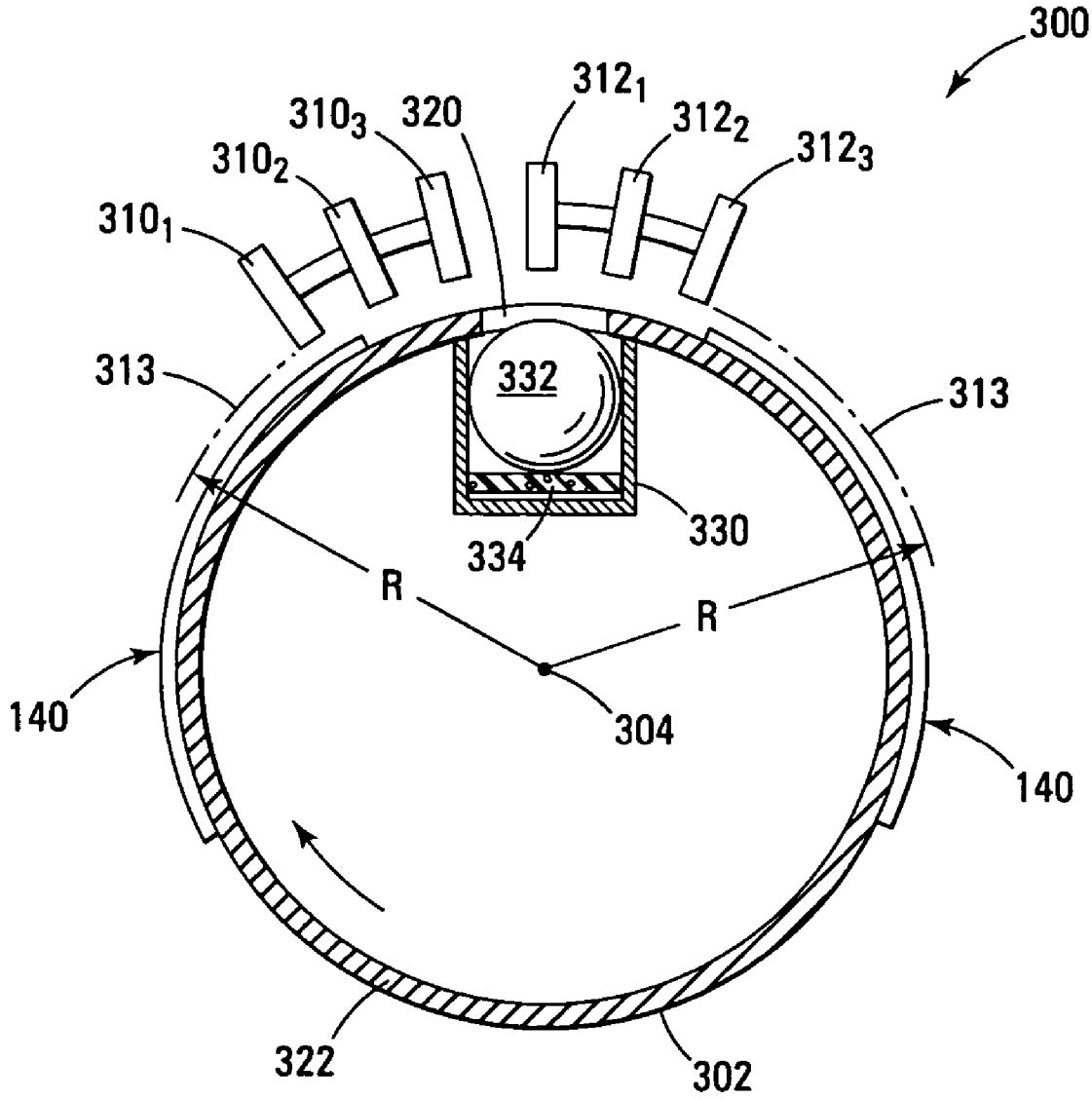
FIG. 4 is a view taken along line 4-4 of FIG. 3.

FIG. 3 is a top view of a portion of a print engine 300, e.g., a portion of the print engine 120 of imaging device 100 of FIG. 1, according to another embodiment of the invention. FIG. 4 is a view of print engine 300 taken along line 4-4 of FIG. 3. Print engine 300 includes a hollow print drum 302, for one embodiment, that is rotatable about a central longitudinal axis (or rotational axis) 304 of print drum 302.

During operation, one or more media sheets 140 are disposed on drum 302, and as drum 302 rotates, it carries the media sheets 140 past a set print heads 310 and a set of print heads 312 of print engine 300, as shown in FIGS. 3 and 4. For one embodiment, print heads 310 and print heads 312 are located at substantially the same radial distance R from rotational axis 304 and are successively disposed along a circumference 313 that is substantially coaxial with print drum 302, as shown in FIG. 4. For another embodiment, print heads 310 and print heads 312 are respectively disposed on opposite sides of a transverse axis 314 that substantially bisects the media sheets 140 and that is substantially perpendicular to the rotational axis 304, as shown in FIG. 3. Thus, print heads 310 and print heads 312 are staggered about transverse axis 314. Print heads 310 and print heads 312 extend in opposite directions from transverse axis 314 and span substantially one half the width W of the media sheets 140, as measured perpendicular to the direction of motion of the media sheets 140, as shown in FIG. 3. Therefore, print heads 310 and print heads 312 are respectively half-page array print heads that act together to function as a page-wide-array print head and thus an imaging device incorporating print engine 300, as described above, is often termed a page-wide-array (or page-width-type) imaging device.

During printing, print heads 310 and print heads 312 remain substantially stationary as print drum 302 carries media sheets past them. However, for some embodiments, print heads 310 and print heads 312 can be moved substantially perpendicular to the direction of motion of the pages, e.g., by about 20 pixels.

For one embodiment, print heads $\mathbf{310}_1$ and $\mathbf{312}_1$ are adapted eject clear fixing liquid through their nozzles onto their corresponding halves of the print region 144 of media sheets 140; print heads $\mathbf{310}_2$ and $\mathbf{312}_2$ are adapted eject substantially opaque black and yellow inks through their nozzles onto their corresponding halves of the print region 144; and print heads $\mathbf{310}_3$ and $\mathbf{312}_3$ are adapted eject substantially opaque cyan and magenta inks through their nozzles onto their corresponding halves of the print region 144. For another embodiment, print heads $\mathbf{310}_1$ and $\mathbf{312}_1$ eject the fixing liquid onto their respective halves of print region 144 prior to print heads $\mathbf{310}_2$ and $\mathbf{312}_2$ and print heads $\mathbf{310}_3$ and $\mathbf{312}_3$ ejecting their inks onto their respective halves of print region 144. Print heads $\mathbf{310}_2$ and $\mathbf{312}_2$ and print heads $\mathbf{310}_3$ and $\mathbf{312}_3$ then eject their inks on the fixing liquid.

For one embodiment, print heads $\mathbf{310}_1$ and $\mathbf{312}_1$ each spit a predetermined number of drops of the fixing liquid through their nozzles onto the non-imaging portion of their respective half of media sheet 140 to purge their nozzles prior to ejecting fixing liquid in print region 144. For some embodiments, when printing on a succession of media sheets 140, the fixing liquid is spit onto margin 150 of each of the media sheets 140 prior to ejecting fixing liquid within the print region 144 of each of the respective media sheets 140. For various embodiments, a look-up table can be used to determine the number of drops of fixer that need to be spit onto the non-imaging portion of media sheet 140, as described above. Alternatively, the number of drops may correspond to a default number of drops, as described above.

For one embodiment, a longitudinal slot 320 passes radially through a wall 322 of print drum 302 and opens into a spittoon 330, as shown in FIG. 4. For another embodiment, spittoon 330 includes a roller 332 that forms a bottom of slot 320. For yet another embodiment, a sponge 334 is disposed in contact with roller 332. In operation, as print drum 302 is rotating, when slot 320 aligns with one of print heads $\mathbf{310}_2$, $\mathbf{310}_3$, $\mathbf{312}_2$, or $\mathbf{312}_3$, the respective print head spits its ink through its nozzles into the slot to purge the nozzles, and roller 332 rotates to carry the spat ink to sponge 334, which wipes the ink from roller 332. For some embodiments, not all of the fixing liquid is spit onto the non-imaging portion of media sheet 140 for purging the nozzles of print heads $\mathbf{310}_1$ and $\mathbf{312}_1$. Instead, print heads $\mathbf{310}_1$ and $\mathbf{312}_1$ spit a portion of the clear fixing liquid into spittoon 330 to purge their nozzles. For another embodiment, print heads are moved to a capping device, such as capping device 132 of imaging device 100 of FIG. 1, that is located at region adjacent print drum 302, for example, at region 350 of FIG. 3.

For another embodiment, print heads 310 can span the entire width W of the media sheets 140 and print heads 312 can be eliminated.

CONCLUSION

Although specific embodiments have been illustrated and described herein it is manifestly intended that this invention be limited only by the following claims and equivalents thereof.

What is claimed is:

1. A method of operating an imaging device, comprising:

purging nozzles of a first fluid-ejection device of the imaging device adapted to eject a clear fixing liquid by ejecting a number of drops of the clear fixing liquid through the nozzles onto a non-imaging portion of a media sheet;

wherein the fluid-ejection device remains stationary while the media sheet moves.

2. The method of claim 1, wherein the number of drops is based a length of time that the fluid-ejection device is uncapped.

3. The method of claim 1, wherein the non-imaging portion of the media sheet comprises at least one of a margin of the media sheet and portions of a print region of the media sheet where images are not to be formed.

4. The method of claim 1, wherein purging nozzles of a first fluid-ejection device further comprises ejecting another number of drops of the clear fixing liquid through the nozzles into a spittoon of the imaging device.

5. The method of claim 1, further comprising purging nozzles of a second ejecting fluid-ejection device of the imaging device adapted to eject a substantially opaque ink by ejecting the substantially opaque ink through the nozzles into a spittoon of the imaging device.

6. A method of operating a page-wide-array imaging device, comprising:

purging nozzles of one or more first print heads of the imaging device adapted to eject a clear fixing liquid by ejecting a number of drops of the clear fixing liquid from the nozzles of the one or more first print heads onto a non-imaging region of a media sheet as the media sheet moves past the one or more first print heads while the one or more first print heads are substantially stationary; and ejecting the fixing liquid through the nozzles of the one or more first print heads onto an imaging portion of the media sheet as the media sheet moves past the one or more first print heads while the one or more first print heads are substantially stationary.

7. The method of claim 6, wherein the media sheet is carried on a rotating drum of the imaging device.

8. The method of claim 7, further comprising purging nozzles of one or more second print heads by ejecting substantially opaque ink through the nozzles into a slot of the rotating drum while the one or more second print heads are substantially stationary.

9. The method of claim 7, further comprising ejecting substantially opaque ink from one or more second print heads on the fixing liquid in the print region while the one or more second print heads are substantially stationary.

10. A computer-usable media containing computer-readable instructions for causing an imaging device to perfrom a method, comprising:

determining a number of drops of a clear fixing liquid to be ejected though nozzles of at least one first print head of the imaging device for purging the nozzles; and purging the nozzles of the at least one first print head by ejecting the determined number of drops of the clear fixing liquid through the nozzles onto a non-imaging portion of a media sheet;

wherein the at least one first print head remains stationary while the media sheet moves.

11. The computer-usable media of claim 10, wherein, in the method, determining the number of drops of the clear fixing liquid comprises using a look-up table contained on the computer-usable media.

12. The computer-usable media of claim 10, wherein, in the method, the number of drops of the clear fixing liquid is based upon at least one of a length of time that the at least one first print head is uncapped, a temperature, and a relative humidity.

13. The computer-usable media of claim 10, wherein the method further comprises purging nozzles of at least one second print head of the imaging device by ejecting substantially opaque ink through the nozzles of the at least one second print head into a spittoon of the imaging device.

14. An imaging device comprising:

at least one first fluid-ejection device adapted to eject a clear fixing liquid;

a drum for conveying the media sheet past the at least one fluid-ejection device; and a controller adapted to instruct the imaging device to purge nozzles of the at least one fluid-ejection first device by ejecting a number of drops of the clear fixing liquid through the nozzles onto a non-imaging portion of a media sheet.

15. The imaging device of claim 14, wherein the controller comprises a look-up table for determining the number of drops to be ejected onto the non-imaging portion of the media sheet.

16. The imaging device of claim 14, further comprising at least one second fluid-ejection device adapted to eject one or more substantially opaque inks onto an imaging portion of the media sheet.

17. The imaging device of claim 16, further comprising a spittoon, wherein the controller instructs the imaging device to purge nozzles of the at least one second fluid-ejection device by ejecting the one or more substantially opaque inks into the spittoon.

18. The imaging device of claim 17, wherein the controller is further adapted to instruct the imaging device to purge nozzles of the one or more first print heads by ejecting another number of drops of the clear fixing liquid through the nozzles of the one or more first print heads into the spittoon.

19. A page-wide-array imaging device comprising:

one or more first print heads adapted to eject a clear fixing liquid onto one or more media sheets;

one or more second print heads adapted to eject one or more substantially opaque inks onto the one or more media sheets;

a rotatable drum for receiving the one or more media sheets thereon and conveying the one or more media sheets past the one or more first print heads and the one or more second print heads while the one or more first print heads and the one or more second print heads are substantially stationary; and a controller adapted to instruct the imaging device to purge nozzles of the one or more first print heads by ejecting a number of drops of the clear fixing liquid through the nozzles onto a non-imaging portion of the one or more media sheets, the controller further adapted to instruct the imaging device to purge nozzles of the one or more second print heads by ejecting a number of drops of the one or more substantially opaque inks through the nozzles of the one or more second print heads into a spittoon disposed within the rotatable drum;

wherein the controller comprises a look-up table for determining the number of drops of clear fixing liquid to be ejected onto the non-imaging portion of each of the one or more media sheets.

20. The page-wide-array imaging device of claim 19, wherein a slot passing through the rotatable drum opens into the spittoon.

21. An imaging device comprising:

a means for ejecting a clear fixing liquid onto a media sheet; and a means for purging the fixing liquid ejecting means by ejecting a number of drops of the clear fixing liquid from the fixing liquid ejecting means onto a non-imaging portion of a media sheet;

wherein the fixing liquid ejecting means remains stationary while the media sheet moves.

22. The imaging device of claim 21, further comprising a means for, determining the number of drops to be ejected onto the non-imaging portion of the media sheet.

23. The imaging device of claim 21, further comprising a means for ejecting one or more substantially opaque inks onto an imaging region of the media sheet.

24. The imaging device of claim 23, further comprising a means for purging the ink ejecting means by ejecting the one or more substantially opaque inks from the ink ejecting means.

25. The imaging device of claim 24, further comprising a means for receiving the one or more substantially opaque inks ejected from the ink ejecting means during purging.

* * * * *

UNITED STATES PATENT AND TRADEMARK OFFICE

CERTIFICATE OF CORRECTION

PATENT NO. : 7,267,422 B2
APPLICATION NO. : 10/862519
DATED : September 11, 2007
INVENTOR(S) : Michael Brookmire et al.

It is certified that error appears in the above-identified patent and that said Letters Patent is hereby corrected as shown below:

In column 6, line 66, in Claim 9, delete “claim 7” and insert -- claim 6 --, therefor.

In column 7, line 4, in Claim 10, delete “perfrom” and insert -- perform --, therefor.

In column 8, line 43, in Claim 22, after “for” delete “,”.

Signed and Sealed this

First Day of July, 2008

JON W. DUDAS
*Director of the United States Patent and Trademark Office*